US011236578B2

(12) United States Patent
Phan et al.

(10) Patent No.: US 11,236,578 B2
(45) Date of Patent: Feb. 1, 2022

(54) ZERO EXTRUSION GAP BARRIER DEVICE USED ON PACKING ELEMENTS

(71) Applicant: HALLIBURTON ENERGY SERVICES, INC., Houston, TX (US)

(72) Inventors: Anthony Phan, Lewisville, TX (US); Nathan J. Harder, Powell, WY (US)

(73) Assignee: Halliburton Energy Services, Inc., Houston, TX (US)

( * ) Notice: Subject to any disclaimer, the term of this patent is extended or adjusted under 35 U.S.C. 154(b) by 148 days.

(21) Appl. No.: 16/697,953

(22) Filed: Nov. 27, 2019

(65) Prior Publication Data

US 2021/0156221 A1 May 27, 2021

(51) Int. Cl.
*E21B 33/12* (2006.01)
*E21B 33/129* (2006.01)
*E21B 33/128* (2006.01)

(52) U.S. Cl.
CPC ..... *E21B 33/1216* (2013.01); *E21B 33/128* (2013.01); *E21B 33/1293* (2013.01)

(58) Field of Classification Search
CPC ..... E21B 33/1216
See application file for complete search history.

(56) References Cited

U.S. PATENT DOCUMENTS 2,603,294 A * 7/1952 Barnes ..... E21B 33/128 166/138
6,343,791 B1 2/2002 Anyan et al.
2002/0043368 A1* 4/2002 Bell ..... E21B 33/1216 166/118
2012/0133098 A1 5/2012 Farquhar
2014/0290946 A1 10/2014 Nguyen et al.
2018/0142528 A1 5/2018 George et al.

FOREIGN PATENT DOCUMENTS

WO WO 2018/186869 * 10/2018 ..... E21B 33/12

* cited by examiner

*Primary Examiner* — Kristyn A Hall
(74) *Attorney, Agent, or Firm* — Haynes and Boone, LLP

(57) ABSTRACT

A wellbore isolation tool, e.g., a bridge plug, provides the ability to seal portions of a well from production or to temporarily seal zones of a well from treatment. A bridge plug may include a sealing element supported by one or more segmented barrier devices that operate to prohibit extrusion of the sealing element as the sealing element is subjected to an axial force. The segmented barrier device may operate passively as segments are driven radially outward by the radial expansion of the sealing element when subject to the axial force and driven radially inward by leaf springs when the axial force is removed. Segments of the segmented barrier device may circumferentially overlap and form a generally flat shoulder supporting the sealing element. The segmented barrier device may include a jacket covering the segments, and a sealing element may be supported by a segmented barrier device on each axial end.

20 Claims, 6 Drawing Sheets

ZERO EXTRUSION GAP BARRIER DEVICE USED ON PACKING ELEMENTS

BACKGROUND

The present disclosure relates generally to equipment and operations for use in a subterranean wellbore. Example embodiments described herein include an expandable barrier device operable to prevent extrusion of a sealing element beyond the barrier device when the sealing element is set in the wellbore.

Wellbore tools such as packers, bridge plugs, etc., include a sealing element that may be employed to fluidly isolate one portion of a wellbore from another. In a hydraulic fracturing operation, for example, a bridge plug may be set to isolate portions of the wellbore that have already been fractured from portions of the wellbore that remain to be fractured. Sealing elements may also be employed for workover, drilling, production or other wellbore operations in which high differential pressures are established across the sealing element.

The sealing elements are often constructed of an elastomeric material that is squeezed or compressed into sealing engagement with a surrounding structure by a compressive force generated or transmitted through the barrier device. Some barrier devices require up to 16,000 pounds of force to impart a compressive stress in the elastomer which causes sufficient radial expansion of the elastomer to form the necessary hydraulic seal in the wellbore. Under such high compressive forces, many elastomers may not remain static, but may ooze, squeeze or otherwise be extruded into gaps defined between the barrier device and the surrounding structure. This extrusion may compromise the sealing integrity provided by the wellbore tool.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure relates generally to a wellbore isolation tool, such as a packer, bridge plug or frac plug, that provides the ability to seal portions of a well from production or to temporarily seal zones of a well from treatment. The wellbore isolation tool may comprise a bridge plug including a sealing element supported by one or more segmented barrier devices that prohibit extrusion of the sealing element as the sealing element is subject to an axial setting force. The segmented barrier device may operate passively as segments of the barrier device are driven radially outward by the radial expansion of the sealing element and radially inward by leaf springs when the axial force is removed. Individual segments of the segmented barrier device may circumferentially overlap one another and form a generally flat shoulder for supporting the sealing element. In some embodiments, a segmented barrier device may include a jacket covering individual segments, and in some embodiments, split rings may be positioned on both axial ends of a sealing element.

Figure 1:
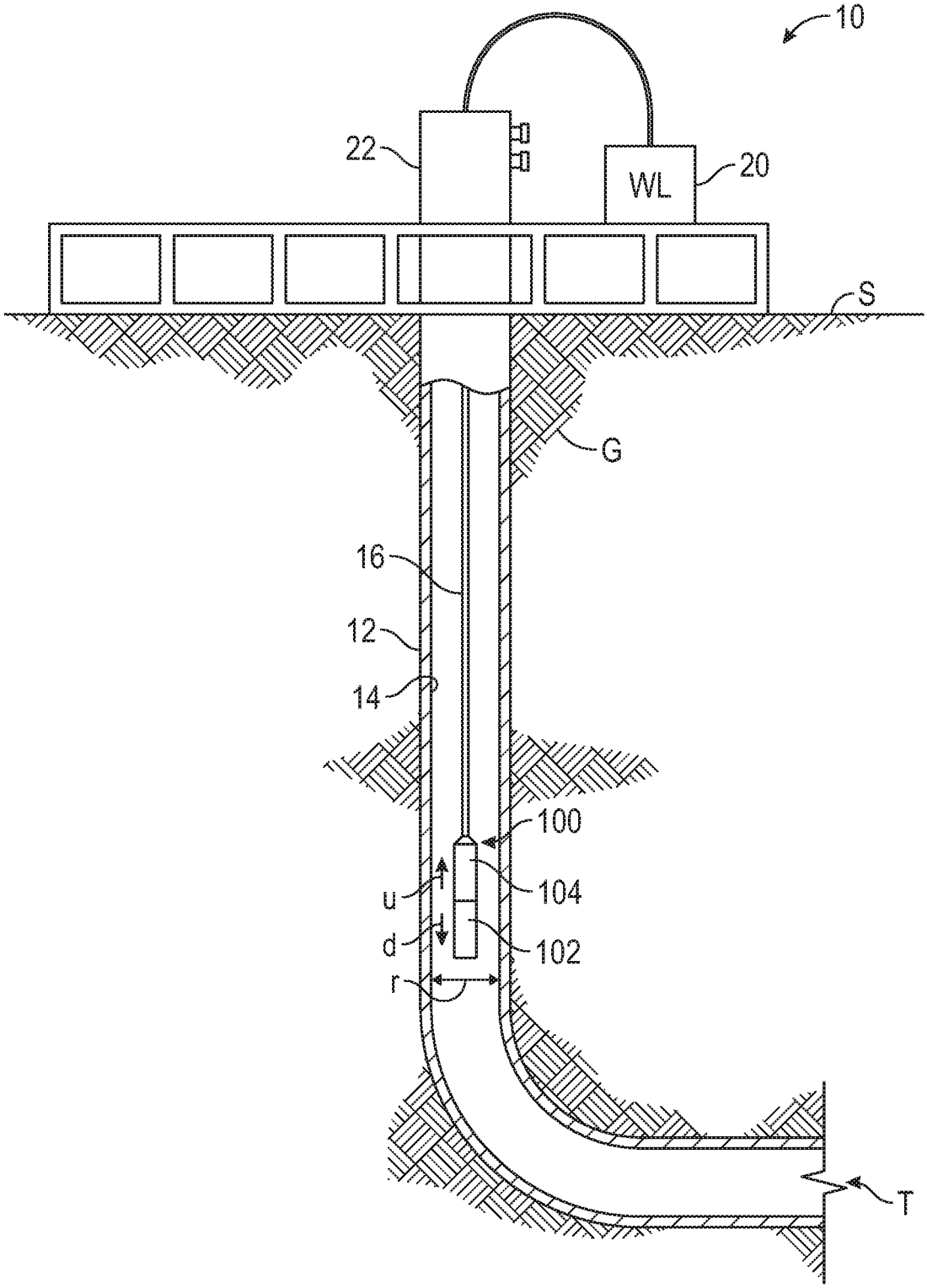
FIG. 1 is a partial, cross-sectional side view of a wellbore system in which a wellbore isolation tool including a bridge plug and a power unit is conveyed into a wellbore on a wireline in accordance with principles of the present disclosure.

Referring to FIG. 1, a wellbore system 10 is illustrated in which a wellbore isolation tool 100 is being conveyed into a wellbore 12. The wellbore system 10 is one exemplary operating environment for the wellbore isolation tool 100 in which the wellbore 12 extends through a geologic formation "G" from a terrestrial surface location "S." In other embodiments, the wellbore isolation tool 100 may also have application in subsea or offshore well systems (not shown) where a wellbore extends from the sea floor. The wellbore 12 may extend from the surface location "S" at an upper end thereof to a lower end or toe "T" along any trajectory. For example, the wellbore 12 may include vertical portions, horizontal portions and any number of deviated and/or curved portions therein. An uphole direction "u" is generally defined toward the surface location "S," a downhole direction "d" is defined toward the toe "T" and a radial direction "r" is generally defined across the wellbore 12. All or any portion of the wellbore 12 may include a casing string 14 cemented therein, which may prevent collapse of the geologic formation into the wellbore 12

A conveyance such as wireline 16 is provided to deploy the wellbore isolation tool 100 to a desired operational position in the wellbore 12. The wireline 16 extends from a surface unit 20 through a wellhead 22 and downhole into wellbore 24. In other embodiments, the wellbore isolation tool 100 may be deployed with coiled tubing systems, slickline systems, wireline tractor systems, or any other conveyance without departing from the scope of the disclosure.

The wellbore isolation tool 100 generally includes a bridge plug 102 and a power unit 104 coupled between the bridge plug 102. The bridge plug 102 is selectively movable between a run-in-hole configuration (radially retracted) and a gripping configuration (radially extended). In the run-in-hole configuration, at least one sealing element 108 (FIG. 2) of the bridge plug 102 is maintained in a radially retracted position substantially spaced from the casing string 14 such that the bridge plug 102 may be readily conveyed in the uphole and downhole directions "u," "d." In the gripping configuration, the sealing element 108 may be axially compressed, which results in a radial expansion of the sealing element 108 into sealing engagement with the casing string 14. The power unit 104 may include an actuator such as an electric motor, hydraulic piston, or another mechanism for transitioning the bridge plug 102 between the run-in-hole and gripping configurations. The power unit 104 may be selectively decoupled from the bridge plug 102 when the bridge plug 102 is in the gripping configuration, such that the power unit 104 may be conveyed out of the wellbore 12 when the bridge plug has been installed at a desired location.

Figure 2:
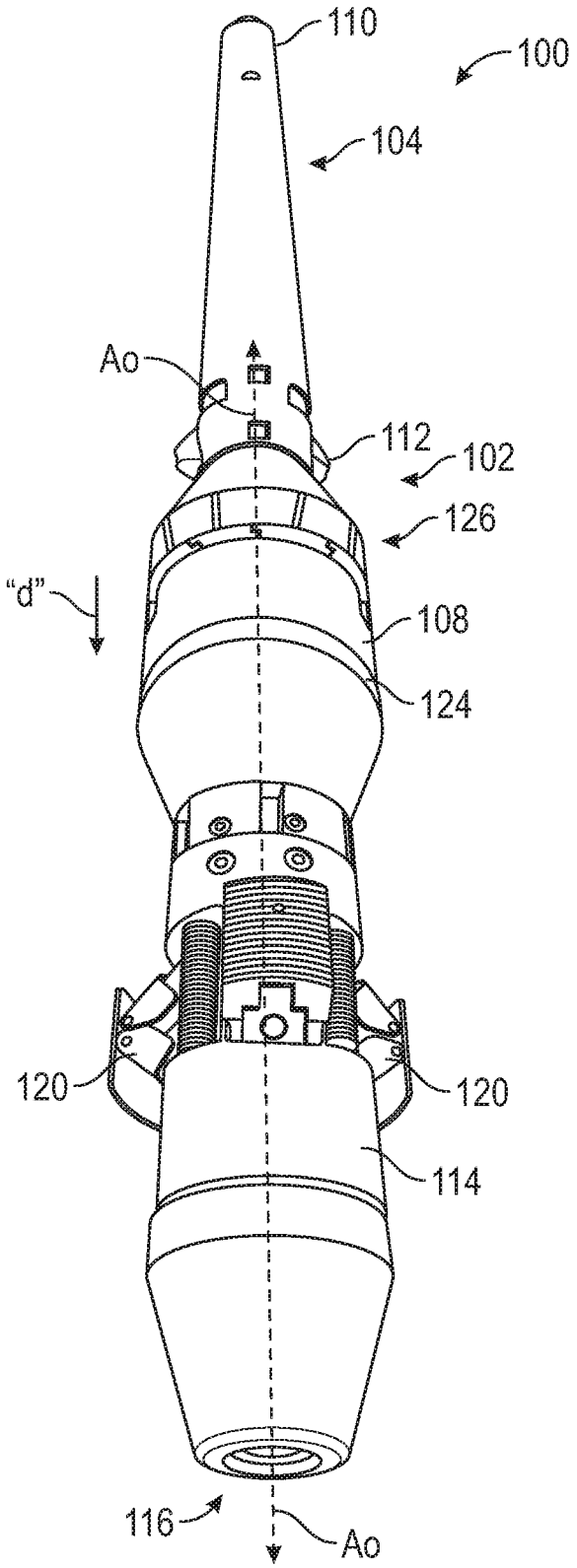
FIG. 2 is a perspective view of the bridge plug and power unit of FIG. 1, illustrating a sealing element of the bridge plug coupled between a segmented barrier device and a lower shoulder of the bridge plug, wherein the power unit is selectively operable to compress the sealing element between the segmented barrier device and the lower shoulder.

Referring now to FIG. 2, the wellbore isolation tool 100 is illustrated in greater detail. The power unit 104 includes wireline connector 110 at its uphole end upper and a latch mechanism 112 at its downhole end. Electrical power, data and instructions may be transmitted through the wireline connector 110 to motors, controllers, sensors, etc. (not shown) within the power unit 104 for operating the latch mechanism 112 and transitioning the bridge plug 102 between the run-in-hole and gripping configurations. The latch mechanism 112 may release the bridge plug 102 once the bridge plug is installed in the wellbore and may also operate to reconnect to the bridge plug 102 for retrieval in some embodiments.

The bridge plug 102 includes a generally cylindrical body 114 extending generally along a longitudinal axis $A_0$. In some embodiments, an optional flowbore 116 may be provided along the longitudinal axis $A_0$ to permit the passage of fluids therethrough, even when the bridge plug 102 is installed. A ball (not shown) or other mechanism may be provided to seal the flow bore 116 by seating against an upper end of the bridge plug 102 when the power unit 104 is detached. One or more slips 120 are mounted around the cylindrical body 114 and are selectively extendable and retractable with respect to the cylindrical body 114 (and extended configuration is illustrated). The slips 120 are generally operable to engage the casing string 14 (FIG. 1), or another surrounding structure, to hold the wellbore isolation tool 100 in a desired position. The slips 120 may include angled inserts or otherwise provide gripping edges on radially outer surfaces thereof for engaging the wellbore.

The sealing element 108 of the bridge plug 102 is provided between a lower shoulder 124 and a segmented barrier device 126. The sealing elements 108 may be constructed materials exhibiting a high tensile strength with sufficient elongation properties to form a seal with the casing string 14. In some example embodiments, suitable materials may exhibit a tensile strength greater than 2000 psi or 3000 psi and may include materials such as cast polyurethane, molded polyurethane and fiber-reinforced nitrile. The lower shoulder 124 and the segmented barrier device 126 may be selectively approximated in an axial direction to cause a radial expansion of the sealing element 108. For example, in some embodiments, the power unit 104 may be operable to impart an axial tensile force to a mandrel 130 (see FIG. 4) extending through the sealing element 108 to draw the segmented barrier 126 device in downhole direction "d" toward the lower shoulder 124. The lower shoulder 126 may have a fixed position and configuration with respect to the cylindrical body 114. As described in greater detail below, the segmented barrier device 126 may be radially expanded by the radial expansion of the sealing element 108 such that an outer diameter of the segmented barrier device approximates an outer diameter of the sealing element 108. In this manner, the segmented barrier device 126 may prohibit extrusion of the sealing element 108 beyond segmented barrier device 126.

Figure 3A:
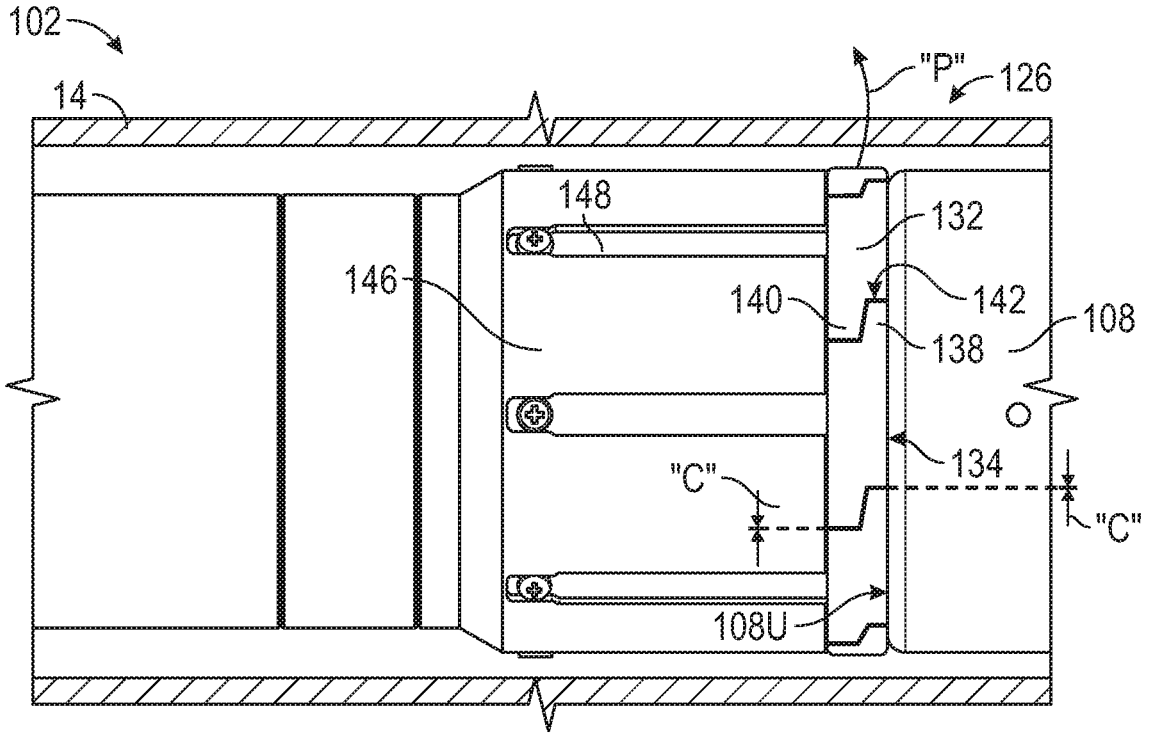
FIGS. 3A and 3B are side views of the segmented barrier device and sealing element of FIG. 2 in an initial or run-in-hole configuration (FIG. 3A) and expanded configuration (FIG. 3B) for forming a seal with a surrounding structure.
Figure 3B:
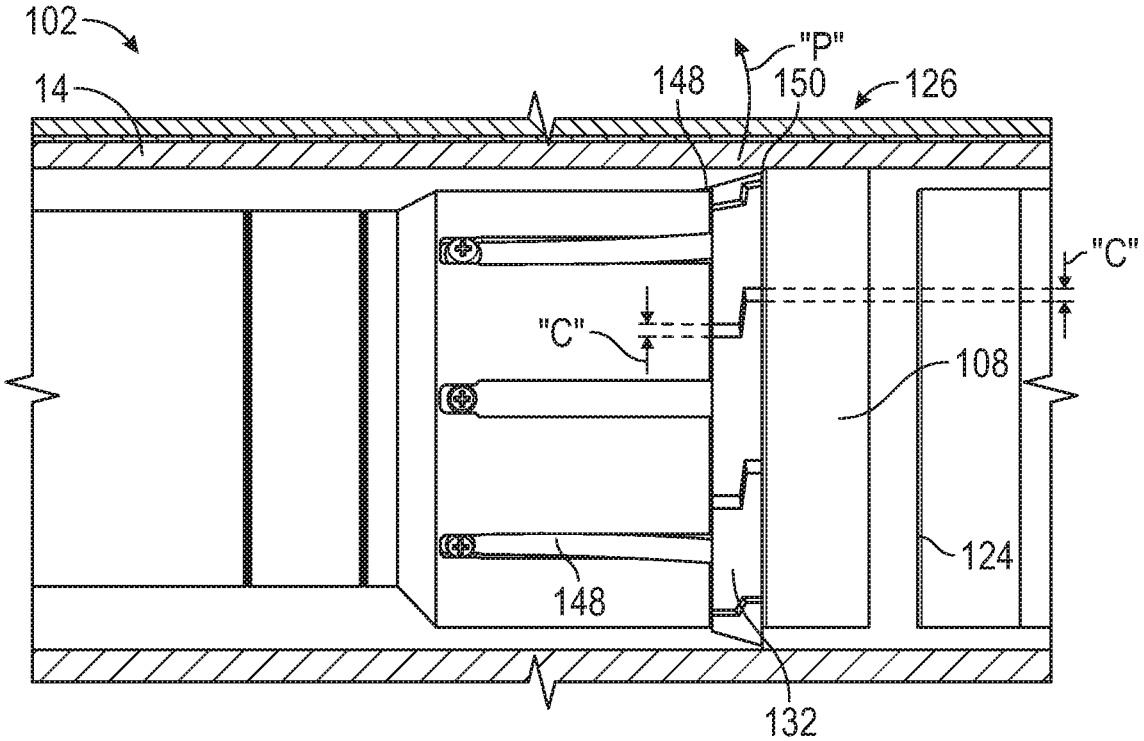

Referring now to FIGS. 3A and 3B, the segmented barrier device 126 is illustrated in the run-in-hole configuration (FIG. 3A) and the expanded configuration (FIG. 3B), respectively. The segmented barrier device 126 includes a plurality of circumferentially spaced segments 132 each including an axial abutment surface 134 in direct contact with a first or upper compression surface 108*u* of the sealing element 108. Each of the segments 132 includes a circumferentially extending tab 138 overlapping a base 140 of a circumferentially adjacent segment 132. Thus, the segments 132 define a complete continuous circumferential profile, which forms an outer perimeter of the of the segmented barrier device 126. Gaps 142 defined between the segments 132 are generally z-shaped and exhibit a circumferential offset "C" between portions of the gap 142 between adjacent the tabs 138 and portions of the gap 142 between adjacent bases 140. The circumferential offset "C" permits the segments 132 to define the continuous circumferential profile, and thereby limit axial extrusion of the sealing element 108 beyond the axial abutment surfaces 134 to forward faces 144 of the bases 140 within the gaps 142. The circumferential offset "C" increases as the segmented barrier device 126 is transitioned from the run-in-hole configuration to the expanded configuration.

Each of the segments 132 is coupled to a housing 146 of the segmented barrier device 126 by a biasing member 148. In the embodiment illustrated in FIGS. 3A and 3B, the biasing member 148 includes an elongate leaf spring fastened to the housing 148 at an end opposite the segment 132. The biasing member 148 urges the segment 132 to a radially retracted position with respect to the housing 146 characterizing the ran-in-hole configuration (FIG. 3A). In the retracted position, each of the segments 132 maintains a radial separation from the casing string 14 such that the bridge plug 102 may readily be run-in to a downhole location. Once at the desired downhole location, the slips 120 (FIG. 2) may be extended to set the position of the bridge plug 102 within the casing string 14, and then the sealing element may radially extended to expanded configuration of FIG. 3B.

As indicated above, the bridge plug 102 may be transitioned to the expanded configuration of FIG. 3B by axially approximating the lower shoulder 124 and the segmented barrier device 126. The axial compression of the sealing element 108 results in the radial extension or expansion of the sealing element 108 into sealing engagement with the casing string 14. This transition of the sealing element imparts axial and radial forces to segments 132 to cause segments 132 pivot in the pivot direction "p" against the bias of the biasing members 148. The segmented barrier device 126 is thereby radially expanded until an outer circumferential edge 150 of the segments 132 may contact the casing string 14 and any potential extrusion gaps between the casing string 14 and the segmented barrier device 126 are eliminated. A robust seal can then be maintained in various downhole scenarios and high-temperature and high-pressure conditions until the lower shoulder 124 and the segmented barrier device 126 are axially separated, permitting the biasing members 148 to return the segments 132 to the radially retracted position of FIG. 3A. Since the contact between the sealing element 108 and the segments 132 drive the radial expansion of the segmented barrier device and the biasing members 148 drive the radial retraction, and since no user input is required beyond what is required to operate the sealing element, the operation of the segmented barrier device 126 may be described as "passive."

Figure 4:
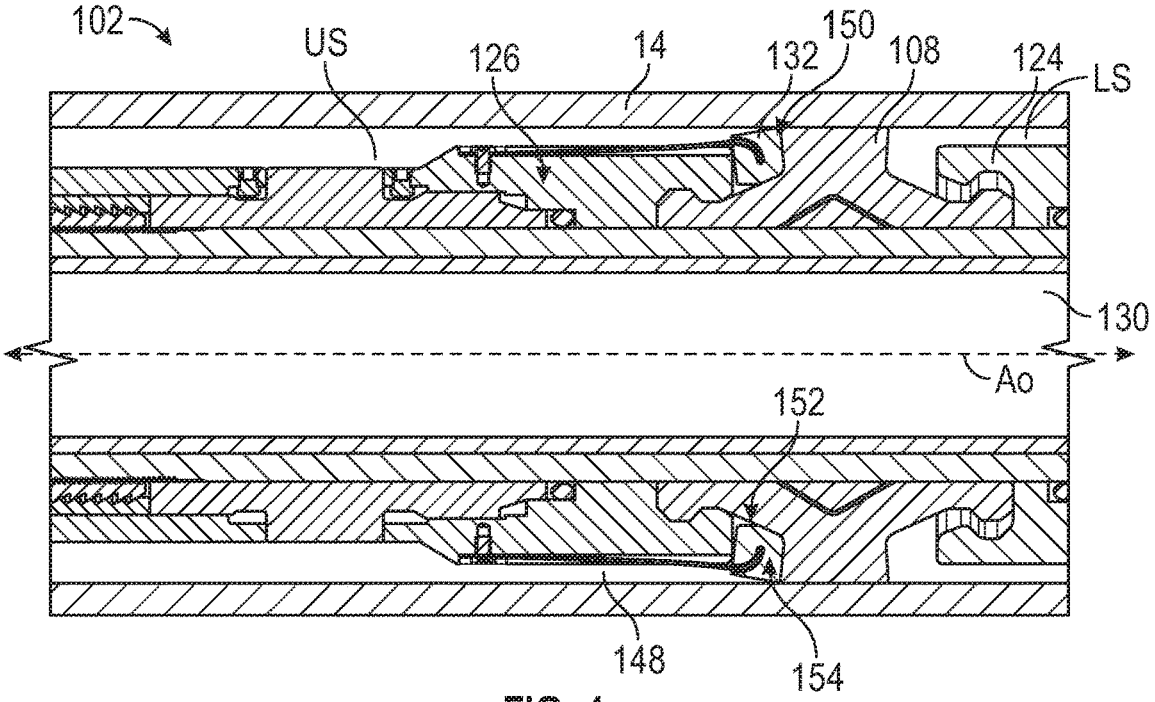
FIG. 4 is a cross-sectional view of the split ring in the expanded configuration illustrating leaf springs coupled to individual segments of the segmented barrier device and a mandrel extending through the bridge plug.

Referring to FIG. 4, the bridge plug 102 includes a mandrel 130 extending generally along the longitudinal axis $A_0$. As described above, an axial force may be applied to the mandrel 130 by the power unit 104 (FIG. 2) to axially approximate the segmented barrier device 126 and the lower shoulder 124, and thereby radially extend the sealing element 108 and the segments 132 into contact with the casing string 14. An increased pressure may then be maintained on a lower side "LS" of the sealing element with respect to the pressure maintained on the upper side "US" of the sealing element 108. The segmented barrier device 126 prevents extrusion of the sealing element 108 under the influence of the increased pressure on the lower side LS. The outer circumferential edge 150 of the segments 132 may define a sharp corner such that the segments 132 may closely engage the casing string 14 and prevent any extrusion of the sealing element 108 past the edge 150. An inner circumferential edge 152 of each of the segments 132 is rounded to reduce stress concentrations that may form that could damage the sealing element 108. The biasing members 148 extend into a curved slot 54 defined in the segments 132 and provide a radially inward bias to the segments 132.

Figure 5:
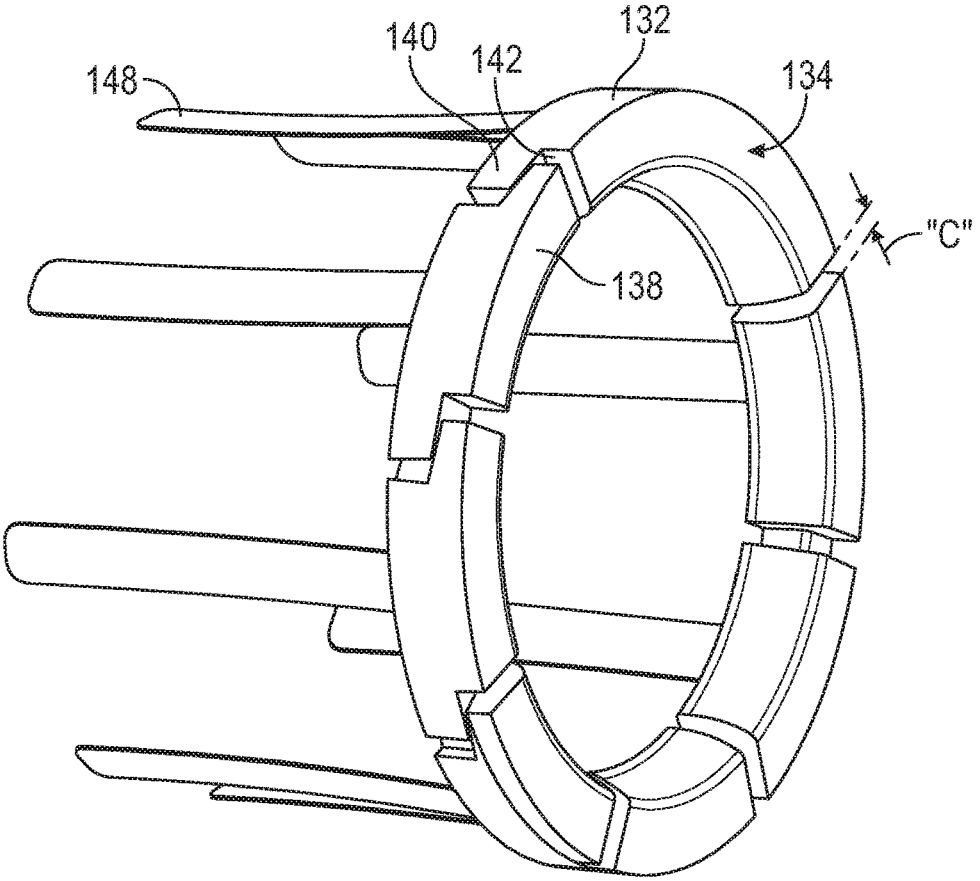
FIG. 5 is a perspective view of the individual segments and the leaf springs of FIG. 4.

Referring to FIG. 5, the individual segments 132 and the biasing members 148 are illustrated in the extended configuration of FIG. 4. The circumferentially extending tabs 138 overlap bases 140 such gaps that gaps 142 extend from the axial abutment surfaces 134 only to the bases 140. The segments 132 provide no direct axial path through the segments through which a sealing element 108 in contact with the axial abutment surface 134 may be extruded. In the embodiment illustrated in FIG. 5, eight (8) individual segments 132 are illustrated, but more or fewer may be provided in other embodiments. Providing a greater number of individual elements 132 may lead to a smaller increase in the circumferential offset "C" as the segments 132 are extended, and thus the size of each of the gaps 142 in the expanded configuration may be smaller than embodiments with fewer segments 132.

Figure 6:
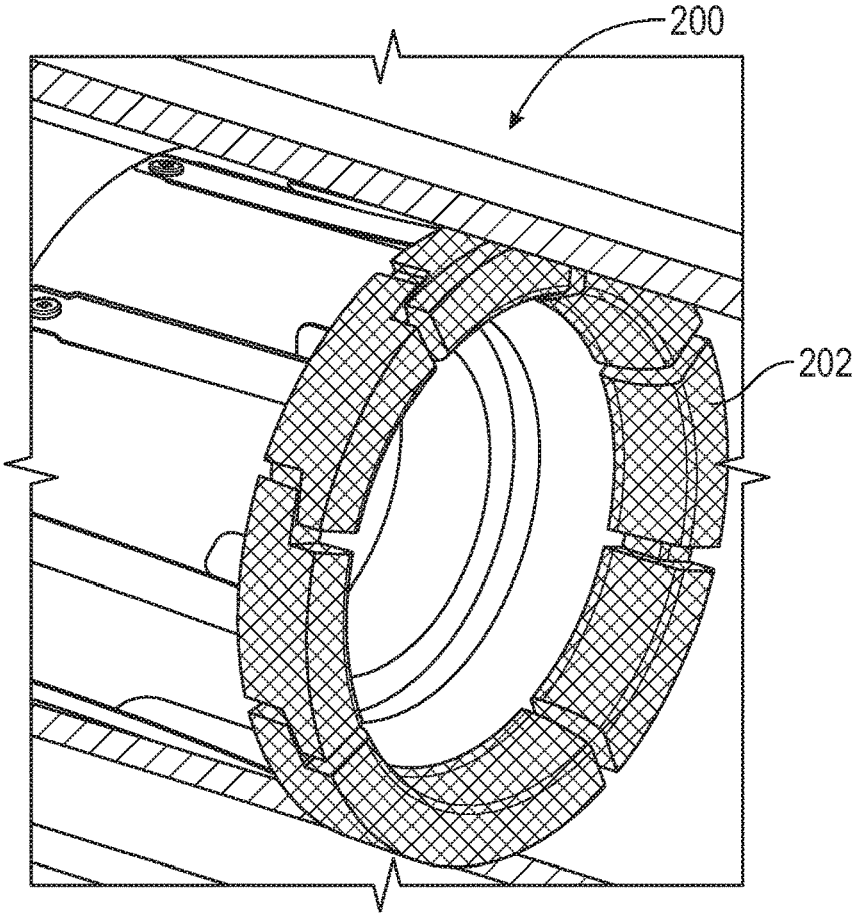
FIG. 6 is a partial perspective view of an alternate embodiment of a segmented barrier device wherein individual segments are covered in a jacket or sleeve.

Referring to FIG. 6, an alternate embodiment of a segmented barrier device 200 includes a jacket 202 or back shoe provided around individual segments 132 (FIG. 5). The jacket 202 may be constructed of metallic material such as 316 stainless steel, austenitic nickel-chromium-based alloys such as annealed Inconel, or C2600 brass. In other embodiments, the jacket 202 may be constructed of a non-metallic material such as fractioned rubber, which may be reinforced with a composition of carbon fiber, fiberglass or Kevlar. The jacket 202 may be flexible and expand with the extension of the segments 132. The jacket covers the gaps 142 (FIG. 5) between the segments 132 and may further prohibit extrusion of the sealing element 108.

Figure 7:
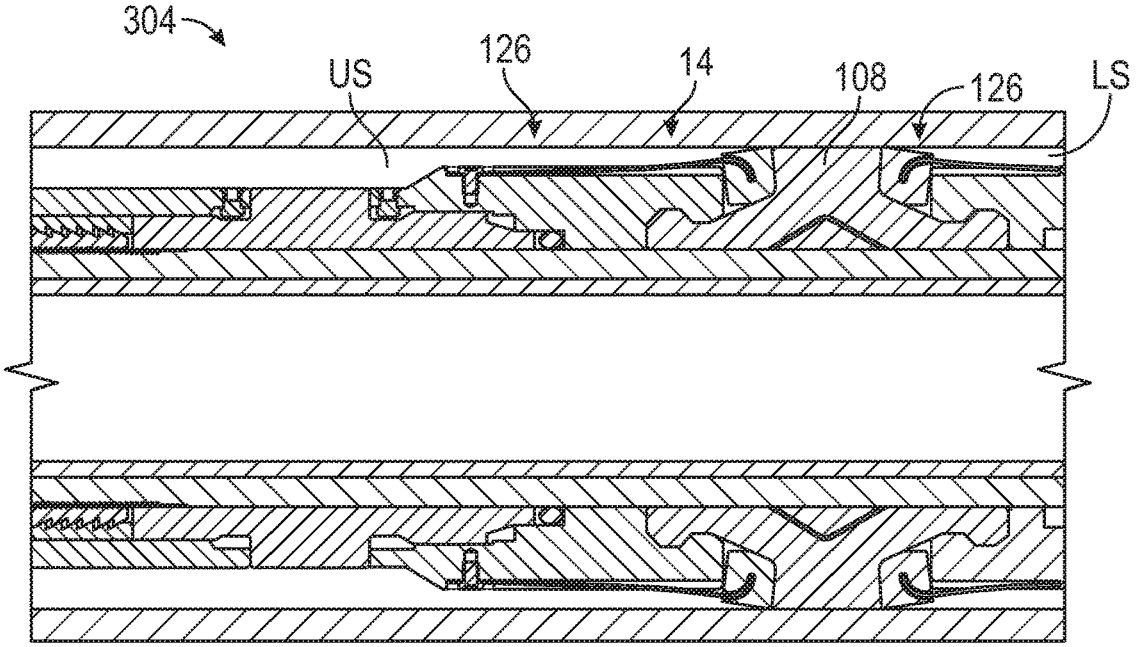
FIG. 7 is a cross sectional view of an alternate arrangement of a wellbore tool including a sealing element coupled between upper and lower segmented barrier devices.

Referring to FIG. 7, an alternate arrangement of a wellbore tool or bridge plug 304 includes a segmented barrier device 126 on both the upper side US and lower side LS of the sealing element 108. An axial force may be applied to the mandrel 130 to approximate the two segmented barrier devices 126 casing string 14. This arrangement may provide bi-directional extrusion protection, permitting an increased pressure to be applied to either the upper side US or lower side LS of the sealing element 108.

Figure 8:
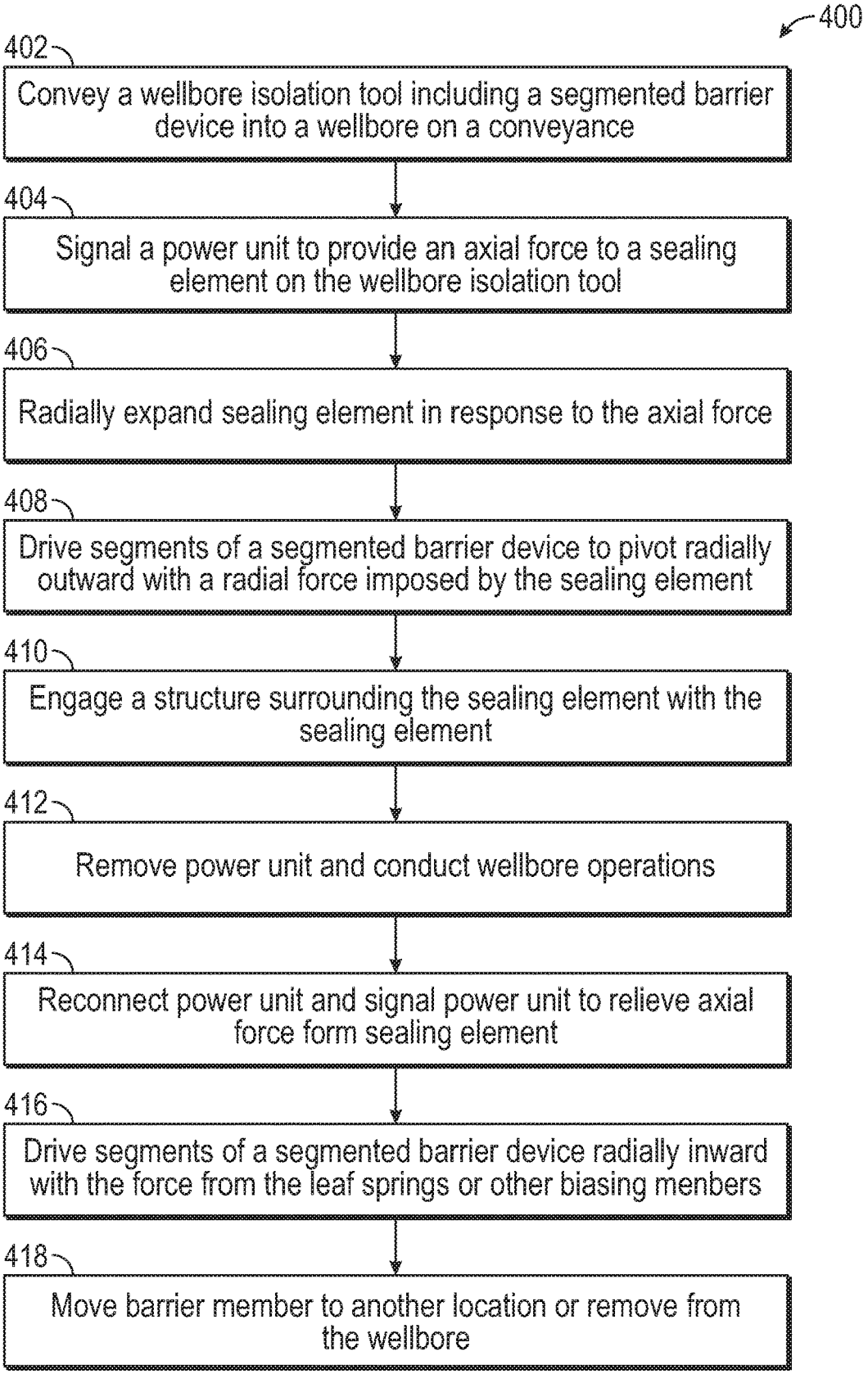
FIG. 8 is a flowchart illustrating an operational procedure for deploying and operating a wellbore tool with a segmented barrier device within a wellbore.

Referring to FIG. 8, an operational procedure 400 is described for deploying and operating a wellbore tool with a segmented barrier device. Initially, at step 402, the wellbore tool is run into the to the wellbore on a wireline or other conveyance. As the wellbore tool is run into the wellbore, the segmented barmier device may be retained in the in the radially retracted configuration. Once the wellbore tool reaches an intended location, an operator may transmit a signal from the surface location through the wireline to a power unit carried by the wellbore tool (step 404). The power unit may then drive a plurality of slips radially outward to engage a casing string or another surrounding structure to maintain the position of the tool in the wellbore. The power unit may then provide an axial force to a mandrel to approximate the segmented barrier device with a shoulder on an opposite side of a sealing element.

At step 406, the sealing element is radially expanded in response to the axial force and the axial approximation of the segmented barrier device and the shoulder. The radial expansion of the sealing element drives the segments of the segmented barrier device radially outward with a radial force imparted by the sealing element. The sealing element also applies an axial force to the segments which, together with the radial force, may cause the segments to pivot over an edge of a housing of the tool so as to engage the surrounding structure with a sharp corner on the segments (step 410).

At step 412, the power unit may be detached from the segmented barrier device and wellbore operations may be conducted in the wellbore. For example, hydraulic fracturing operations may be conducted in a wellbore zone on an opposite side of the sealing element from the segmented barrier device. The segmented barrier device supports the sealing element against an increased pressure in the wellbore zone being hydraulically fractured and prevents extrusion of the sealing element beyond the segments. An effective seal is thus maintained and damage to the sealing element is prevented.

At step 412, once the wellbore operations are complete, the power unit may be returned to the wellbore tool and reconnected. A signal may be transmitted to the power unit to relieve the axial force from the sealing element to permit the sealing element to return a radially retracted configuration spaced from the wellbore wall. The leaf springs or other biasing members then drive the segments radially inward toward the housing (step 416). With the sealing element and segmented barrier device in the radially retracted configuration, wellbore tool may be moved with the conveyance to another location in the wellbore or removed (step 418.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect, the disclosure is directed to a wellbore isolation tool that includes a mandrel defining a longitudinal axis, and a sealing element disposed about the mandrel and having a first and second axially-facing compression surfaces. The sealing element is elastically deformable to expand radially outward in response to an axial compression force applied between the compression surfaces. The wellbore isolation tool also includes a segmented barrier device having an abutment surface in direct contact with the first compression surface of the sealing element, the segmented barrier device including a plurality of circumferentially overlapping segments defining a continuous and complete circular profile around the mandrel, wherein the plurality of overlapping segments expand radially outward in response to radial expansion of the sealing element.

In one or more embodiments, each segment of the segmented barrier device is pivotally coupled to a housing such that each segment pivots radially outward in response to the radial expansion of the sealing element. Each segment of the segmented barrier device may include an outer circumferential edge of the abutment surface defining a sharp corner for engaging a surrounding structure.

In some embodiments, the wellbore isolation tool further includes a plurality of elongated biasing members coupled between the housing and the plurality of segments, each biasing member biasing a respective segment to a radially retracted position with respect to the housing. Each of the elongated biasing members may be seated within an elongated recess formed in the housing.

In one or more embodiments, the wellbore isolation tool further includes a jacket formed over the plurality of overlapping segments, the jacket covering circumferential gaps defined between adjacent segments of the plurality of segments. The jacket may be constructed of a non-metallic material including at least one of the group consisting of fractioned rubber, carbon fiber and fiberglass. In some embodiments, the jacket is constructed of a metallic material including at least one of the group consisting of stainless steel, an austenitic nickel-chromium-based alloys and brass. The wellbore isolation tool may further include a second segmented barrier device in contact with the second compression surface of the sealing element.

According to another aspect, a wellbore isolation system includes a power unit having a connector at an upper end thereof for coupling the power unit to a wellbore conveyance. A mandrel defines a longitudinal axis and is operably coupled a lower end of the power unit. The mandrel is operable to receive an axial force from the power unit and to impart the axial force to a body defining a shoulder thereon. A segmented barrier device has an abutment surface defined on a plurality of circumferentially overlapping segments, and the segments define a continuous and complete circular profile around the mandrel. A sealing element is disposed about the mandrel and axially between the segmented barrier device and the body. The sealing element has a first compression surface in contact with the abutment surface of the segmented barrier device and a second compression surface in contact with the shoulder of the body. The sealing element is deformable to expand radially outward in response to the axial force applied between the compression surfaces and to drive the segments of the segmented barrier device radially outward.

In one or more embodiments, the power unit is selectively detachable from a housing coupled to the segmented barrier device. Each segment of the plurality of segments may be pivotally coupled to the housing, n some embodiments, the wellbore isolation system further includes a plurality of biasing members coupled to the plurality of segments to bias the plurality of segments to a radially retracted configuration with respect to the housing.

In some embodiments, z-shaped gaps may be defined between each segment of the plurality of segments. The wellbore isolation system may further include a plurality of slips operably coupled to the power unit for selective extension from the body. In some embodiments, the wellbore isolation system further includes a wireline coupled the connector of the power unit.

In another aspect, the disclosure is directed to a method of deploying and operating a wellbore isolation tool. The method includes (a) running wellbore isolation tool into a wellbore on a conveyance, (b) signaling a power unit carried by the wellbore isolation tool to radially expand a sealing element into engagement with a surrounding structure in the wellbore, (c) driving a plurality segments of a segmented barrier device radially outward in response to the radial expansion of the sealing element, the plurality of segments defining a complete circumferential profile and (d) engaging an inner surface of the surrounding structure with the segments to prohibit extrusion of the sealing element past the segmented barrier device.

In some embodiments, driving the plurality of segments radially outward includes pivoting the plurality of segments. The method may further include signaling the power unit to permit the sealing element to radially retract and to permit each segment of the plurality of segments to return to a radially retracted configuration under a bias from a biasing member. In some embodiments, the method further includes pressurizing a wellbore zone on an opposite side of the sealing element from the segmented barrier device.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A wellbore isolation tool, comprising:

a mandrel defining a longitudinal axis;

a sealing element disposed about the mandrel and having a first and second axially-facing compression surfaces, wherein the sealing element is elastically deformable to expand radially outward in response to an axial compression force applied between the compression surfaces;

a segmented barrier device having an abutment surface in direct contact with the first compression surface of the sealing element, the segmented barrier device including a plurality of circumferentially overlapping segments defining a continuous and complete circular profile around the mandrel, wherein the plurality of overlapping segments expand radially outward in response to radial expansion of the sealing element;

a housing defining an axial support surface thereon, the axial support surface engaging the segmented barrier device on an axial surface of each of the segments opposite the abutment surface, wherein each segment of the segmented barrier device is pivotally coupled to the housing such that each segment pivots radially outward over an outer circumferential edge of the housing in response to the radial expansion of the sealing element; and a plurality of elongated biasing members coupled between the housing and the plurality of segments, each biasing member extending into a slot defined on the axial surface of a respective segments opposite the abutment surface to bias the respective segment to a radially retracted position with respect to the housing.

2. The wellbore isolation tool of claim 1, wherein each segment of the segmented barrier device includes an outer circumferential edge of the abutment surface defining a sharp corner for engaging a surrounding structure.

3. The wellbore isolation tool of claim 1, wherein each of the elongated biasing members is seated within an elongated recess formed in the housing.

4. The wellbore isolation tool of claim 1, further comprising a jacket formed over the plurality of overlapping segments, the jacket covering circumferential gaps defined between adjacent segments of the plurality of segments.

5. The wellbore isolation tool of claim 4, wherein the jacket is constructed of a non-metallic material including at least one of the group consisting of fractioned rubber, carbon fiber and fiberglass.

6. The wellbore isolation tool of claim 4, wherein the jacket is constructed of a metallic material including at least one of the group consisting of stainless steel, an austenitic nickel-chromium-based alloys and brass.

7. The wellbore isolation tool of claim 1, further comprising a second segmented barrier device in contact with the second compression surface of the sealing element.

8. The wellbore isolation tool of claim 1, wherein the elongated biasing members curve radially inwardly within the slot.

9. The wellbore isolation tool of claim 1, wherein the abutment surface of the segmented barrier device and the first compression surface of the sealing element in direct contact with one another are generally orthogonal to the longitudinal axis.

10. A wellbore isolation system, comprising:

a power unit having a connector at an upper end thereof for coupling the power unit to a wellbore conveyance;

a mandrel defining a longitudinal axis and operably coupled a lower end of the power unit;

the mandrel operable to receive an axial force from the power unit and to impart the axial force to a body defining a shoulder thereon;

a segmented barrier device having an abutment surface defined on a plurality of circumferentially overlapping segments, the segments defining a continuous and complete circular profile around the mandrel; and a sealing element disposed about the mandrel and axially between the segmented barrier device and the body, the sealing element having a first compression surface in contact with the abutment surface of the segmented barrier device and a second compression surface in contact with the shoulder of the body, the sealing element deformable to expand radially outward in response to the axial force applied between the compression surfaces and to drive the segments of the segmented barrier device radially outward;

a housing defining an axial support surface thereon, the axial support surface engaging the segmented barrier device on an axial surface of each of the segments opposite the abutment surface, wherein each segment of the segmented barrier device is pivotally coupled to the housing such that each segment pivots radially outward over an outer circumferential edge of the housing in response to the radial expansion of the sealing element; and a plurality of elongated biasing members coupled between the housing and the plurality of segments, each biasing member extending into a slot defined on the axial surface of a respective segments opposite the abutment surface to bias the respective segment to a radially retracted position with respect to the housing.

11. The wellbore isolation system of claim 10, wherein the power unit is selectively detachable from a housing coupled to the segmented barrier device.

12. The wellbore isolation system of claim 10, wherein z-shaped gaps are defined between each segment of the plurality of segments.

13. The wellbore isolation system of claim 10, further comprising a plurality of slips operably coupled to the power unit for selective extension from the body.

14. The wellbore isolation system of claim 10, wherein the wellbore conveyance comprises a wireline coupled to the connector of the power unit.

15. The wellbore isolation system of claim 10, wherein the abutment surface of the segmented barrier device and the first compression surface of the sealing element in direct contact with one another are generally orthogonal to the longitudinal axis.

16. The wellbore isolation system of claim 10, wherein the elongated biasing members curve radially inwardly within the slot.

17. A method of deploying and operating a wellbore isolation tool, the method comprising:

running wellbore isolation tool into a wellbore on a conveyance;

signaling a power unit carried by the wellbore isolation tool to radially expand a sealing element into engagement with a surrounding structure in the wellbore;

driving a plurality segments of a segmented barrier device radially outward in response to the radial expansion of the sealing element, the plurality of segments defining a complete circumferential profile, wherein driving the plurality of segments radially outward comprises pivoting the plurality of segments over an outer circumferential edge of the a housing in response to the radial expansion of the sealing element;

engaging an inner surface of the surrounding structure with the segments to prohibit extrusion of the sealing element past the segmented barrier device; and biasing the plurality of segments toward a radially retracted position with respect to the housing with a plurality of elongated biasing members coupled between the housing and the plurality of segments, each biasing member extending into a slot defined on an axial surface of the a respective segments opposite the sealing element.

18. The method of claim 17, further comprising signaling the power unit to permit the sealing element to radially retract and to permit each segment of the plurality of segments to return to a radially retracted configuration under a bias from the respective biasing member.

19. A method of claim 17, further comprising pressurizing a wellbore zone on an opposite side of the sealing element from the segmented barrier device.

20. The method of claim 17, wherein engaging the inner surface of the surrounding structure includes engaging the inner surface only with a sharp corner at an outer circumferential edge of the segments.

* * * * *